US007752821B2

(12) United States Patent
Jankovec et al.

(10) Patent No.: US 7,752,821 B2
(45) Date of Patent: Jul. 13, 2010

(54) SUSPENDED CEILING SYSTEM

(75) Inventors: Scott G. Jankovec, Elmhurst, IL (US); Peter G. Jahn, Palos Park, IL (US); Thomas E. Smith, Darien, IL (US)

(73) Assignee: Chicago Metallic Corporation, Chicago, IL (US)

( * ) Notice: Subject to any disclaimer, the term of this patent is extended or adjusted under 35 U.S.C. 154(b) by 279 days.

(21) Appl. No.: 11/257,726

(22) Filed: Oct. 25, 2005

(65) Prior Publication Data

US 2006/0101764 A1 May 18, 2006

Related U.S. Application Data

(60) Provisional application No. 60/622,418, filed on Oct. 27, 2004.

(51) Int. Cl.
*E04B 9/00* (2006.01)

(52) U.S. Cl. ..... 52/506.07; 52/506.01; 52/245; 52/506.08; 248/62; 248/57; 248/74.1; 403/395; 403/398; 403/399; 403/400

(58) Field of Classification Search ..... 52/245, 52/506.01, 506.07, 506.06, 506.08, 22, 665, 52/666, 506, 660, 848, 585.1; 248/62, 57, 248/74.4, 74.1; 403/386, 395, 397, 398, 403/399

See application file for complete search history.

(56) References Cited

U.S. PATENT DOCUMENTS

| | | | | | |
|---|---|---|---|---|---|
| 420,293 | A | * | 1/1890 | Bowers | 52/506.06 |
| 555,097 | A | * | 2/1896 | Hurd | 52/506.06 |
| 2,155,694 | A | * | 4/1939 | Tench | 52/669 |
| 2,155,964 | A | * | 4/1939 | Bowers et al. | 210/292 |
| 2,710,679 | A | * | 6/1955 | Bibb et al. | 403/217 |
| 2,912,075 | A | * | 11/1959 | Pfistershammer | 52/834 |
| 2,946,414 | A | * | 7/1960 | Gordon et al. | 52/476 |
| 3,015,375 | A | * | 1/1962 | Lickliter et al. | 403/219 |
| 3,159,251 | A | | 12/1964 | Becker | |
| 3,463,428 | A | * | 8/1969 | Kindorf et al. | 248/72 |
| 3,798,865 | A | | 3/1974 | Curtis | |
| 3,911,638 | A | * | 10/1975 | Englund et al. | 52/506.08 |
| 3,918,234 | A | * | 11/1975 | Weissman | 52/39 |
| 4,040,758 | A | * | 8/1977 | Sauer | 403/397 |
| 4,044,428 | A | * | 8/1977 | Kowalski | 24/16 R |
| 4,191,352 | A | | 3/1980 | Schuplin | |
| 4,257,205 | A | | 3/1981 | Kuhr | |
| 4,389,828 | A | | 6/1983 | Cary | |

(Continued)

OTHER PUBLICATIONS

USG Introducing the Cuyrvatura Elite Ceiling System, 2000.

(Continued)

*Primary Examiner*—Robert J Canfield
*Assistant Examiner*—Matthew J Gitlin
(74) *Attorney, Agent, or Firm*—Cook Alex Ltd.

(57) ABSTRACT

A grid system is provided that is particularly suited for the suspended ceiling system that varies in the vertical plane. An elongated carrier tube is provided the spans substantially the width of the grid system that has a slot therein adapted to receive the strengthening bulb of a main runner. A clip is provided that seats on the carrier tube that has opposed faces for capturing the bulb of the runner, so as to secure the runner to the tube carrier.

12 Claims, 4 Drawing Sheets

U.S. PATENT DOCUMENTS 4,417,711 A * 11/1983 Madej ..... 248/74.4
4,479,341 A * 10/1984 Schuplin ..... 52/665
4,494,350 A 1/1985 Sharp
4,559,751 A * 12/1985 Rogers ..... 52/665
4,580,386 A 4/1986 Hemphill et al.
4,583,340 A * 4/1986 Sauer ..... 52/506.07
4,610,562 A 9/1986 Dunn
4,630,423 A 12/1986 Lind
4,640,077 A 2/1987 Hall
4,641,987 A 2/1987 Schlegel
4,715,161 A 12/1987 Carraro et al.
4,761,930 A * 8/1988 Tepera ..... 52/669
4,794,745 A * 1/1989 Platt et al. ..... 52/506.07
4,850,172 A 7/1989 Gailey et al.
4,927,103 A * 5/1990 Nicholson ..... 248/62
4,932,170 A 6/1990 Spear
4,989,387 A * 2/1991 Vukmanic et al. ..... 52/667
5,024,404 A * 6/1991 Ballard ..... 248/62
5,046,294 A 9/1991 Platt
5,077,951 A 1/1992 Baker
5,088,261 A 2/1992 Mieyal et al.
5,137,390 A 8/1992 Felsen
5,149,221 A 9/1992 Slapsys
5,154,031 A 10/1992 Wall
5,201,787 A 4/1993 LaLonde et al.
5,214,900 A * 6/1993 Folkerts ..... 52/696
5,234,654 A * 8/1993 Brooks ..... 264/219
5,271,202 A 12/1993 Vukmanic et al.
5,313,759 A * 5/1994 Chase, III ..... 52/506.06
5,413,300 A * 5/1995 Hosteing ..... 248/317
5,435,514 A * 7/1995 Kerr, Jr. ..... 248/343
5,572,844 A * 11/1996 Stackenwalt et al. ..... 52/506.07
5,619,833 A * 4/1997 Neff ..... 52/506.07
5,839,246 A 11/1998 Ziegler et al.
5,839,703 A * 11/1998 Tesar ..... 248/65
5,901,524 A * 5/1999 Wright ..... 52/668
5,911,664 A * 6/1999 Masters et al. ..... 52/698
5,927,037 A 7/1999 Kinsella
5,937,605 A * 8/1999 Wendt ..... 52/506.06
5,979,134 A * 11/1999 Neff ..... 52/506.07
6,018,923 A 2/2000 Wendt
6,047,511 A 4/2000 Lehane et al.
6,047,512 A * 4/2000 Wendt et al. ..... 52/506.07
6,047,517 A * 4/2000 Vrame ..... 52/506.06
6,105,216 A * 8/2000 Opperthauser ..... 24/459
6,138,425 A 10/2000 Wendt
6,199,343 B1 3/2001 Sauer et al.
6,230,464 B1 * 5/2001 Vrame ..... 52/506.08
6,260,810 B1 * 6/2001 Choi ..... 248/65
6,305,139 B1 10/2001 Sauer
6,318,042 B1 * 11/2001 Bloom et al. ..... 52/506.07
6,374,564 B1 * 4/2002 Fletterick et al. ..... 52/506.07
6,402,096 B1 * 6/2002 Ismert et al. ..... 248/68.1
6,523,313 B2 2/2003 Lin et al.
6,598,361 B2 * 6/2003 Ting ..... 52/235
6,763,641 B1 * 7/2004 Ahren et al. ..... 52/506.06
6,834,467 B2 * 12/2004 Gulbrandsen et al. .... 52/506.07
D538,148 S * 3/2007 Dinh et al. ..... D8/396
7,223,052 B1 * 5/2007 Evans ..... 405/184.4
7,578,107 B2 * 8/2009 Platt ..... 52/506.06
2002/0152704 A1 10/2002 Thompson et al.
2003/0177735 A1 * 9/2003 Seeba et al. ..... 52/726.2
2003/0200719 A1 10/2003 Koski et al.
2003/0205016 A1 * 11/2003 Gulbrandsen et al. .... 52/506.06
2003/0226322 A1 12/2003 Platt
2003/0230043 A1 * 12/2003 Likozar et al. ..... 52/506.07
2005/0217194 A1 * 10/2005 Krantz-Lilienthal et al. ..... 52/506.06
2006/0016145 A1 * 1/2006 Lonneman ..... 52/506.06
2006/0096219 A1 * 5/2006 Ingratta et al. ..... 52/506.07
2007/0130869 A1 * 6/2007 Platt ..... 52/506.08

OTHER PUBLICATIONS

USG Curvatura 3-Dimensional System, 2001.
USG Drywall Suspension System, Suspension Systems for Curved Drywall Ceilings, 2002.
Armstrong, Serpentina 3-Dimensional Ceiling System, date-unknown.

* cited by examiner

SUSPENDED CEILING SYSTEM

CROSS REFERENCE TO RELATED APPLICATION

This application claims the benefit of the filing date of U.S. Provisional Application Ser. No. 60/622,418, filed Oct. 27, 2004, which is incorporated herein by reference.

BACKGROUND OF THE INVENTION

Suspended ceilings of various shapes and sizes are being increasingly used in order to add interest to various public spaces, such as retail outlets, contemporary office lobbies and halls, entertainment establishments, and the like. This has lead to the creation of suspended ceiling systems for defining spaces in which the ceiling panels lie in more than one plane, such as in vaults, transitions between different ceiling heights, islands, and waves.

One problem with such non-conventional ceiling systems is the difficulty of installing the suspending grid so that the runners for supporting the associated ceiling panels are maintained in accurate alignment. In particular, this difficulty has lead to increased time and cost for the assembly of such suspended ceiling systems.

Accordingly, by way of the invention described herein, a suspended ceiling system is provided that is particularly suited for providing a grid system that is curved in vertical plane, provides for accurate spacing and alignment of the grid elements, and facilitates quick assembly and installation of the assembled grid system.

DETAILED DESCRIPTION OF THE PREFERRED EMBODIMENT

Figure 1:
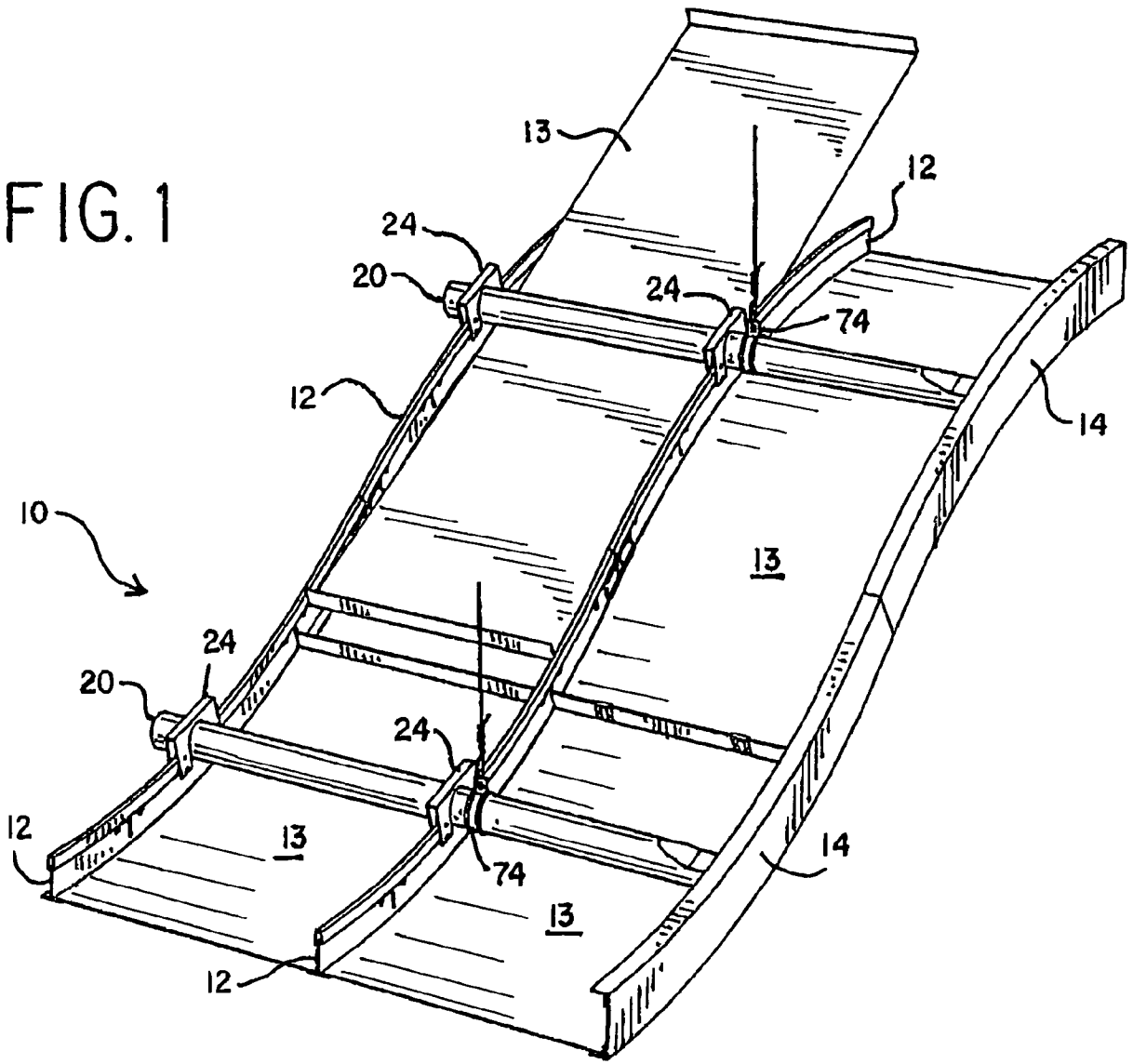
FIG. 1 is a perspective view of a grid system for a curved suspended ceiling in accordance with the present invention.
Figure 2:
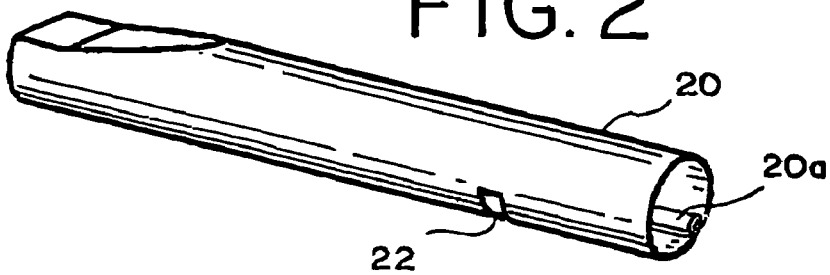
FIG. 2 is a perspective view of a portion of a primary carrier in accordance with the present invention.

The present invention comprises an assembly particularly suited for a curved suspended ceiling grid. With reference to FIG. 1, the system, generally designated 10, includes main runners or tees 12 which are curved in a vertical plane to support either flexible panels 13 or preformed, lay-in panels (not shown), the latter requiring cross-tees between adjacent main tees. The curve may be either concave or convex with respect to the exposed side of the ceiling system. Edge or perimeter trim pieces 14 (which may be either curved or straight, as required to correspond to the shape of the main runners 12), having opposed interior slots define the perimeter of the suspended ceiling. Corner clips are used to secure the perimeter trim pieces to each other. However, the perimeter trim may be omitted, if desired, without departing from the invention. Each of the main runners, trim pieces and corner clips have previously been available from Chicago Metallic Corporation, assignee of the present application, under the "CurvGrid" and "CurvTrim" trademarks.

In keeping with one aspect of the present invention, one or more primary or tube carriers, generally designated 20, is utilized to interconnect the main runners 10 and provide a unitized, rigid grid system. Each primary carrier 20 preferably extends substantially the full width of the suspended ceiling and is preferably spaced no more than about 48 inches from the adjacent primary carrier. The primary carrier 20 may be of any length that is practical given both manufacturing and shipping constraints, and typically may be as long as 16 feet in length.

The primary carrier 20 preferably has a circular cross-section, with an outside diameter of approximately 1.25 inches, although other cross-sectional shapes and sizes may be utilized without departing from the invention. The primary carrier has a notch or slot 22 for each of the main runners supported by the tube carrier 20, the notch 22 being sized in width and depth to receive the bulb of the main runner. In a preferred embodiment, the tube carrier 20 is roll-formed from 0.028 inch thick steel with a lock seam 20*a*. The notches 22 aid in the installation of the ceiling by maintaining on-center spacing of the main runners 10 without the use of cross tees.

Figure 3:
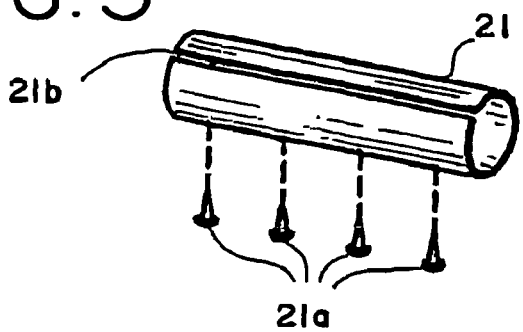
FIG. 3 is a perspective view of a splice for connecting primary carriers in accordance with the present invention.
Figure 4:
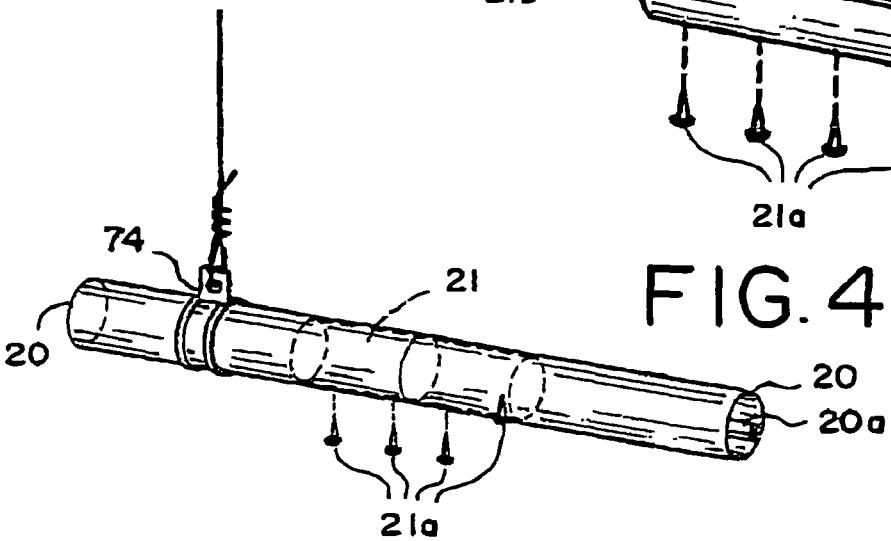
FIG. 4 is a perspective view showing the splice of FIG. 3 joining two primary carriers in accordance with present invention.

If the width of the curved ceiling is greater than the length of a single primary carrier 20, adjacent primary carriers can be staggered so that together they extend substantially the full width of the ceiling. More preferably, one or more primary carriers may be joined together end-to-end to obtain the desired length by using a splice connector 21, as shown in FIG. 3. With reference to FIGS. 3 and 4, approximately half the length of the splice connector 21 is received in the interior of each of the two primary carriers joined thereby. The primary carriers and splice connector may be positively secured to one another by fasteners, such as screws 21*a*. The primary carriers 20 may also include an inwardly-projecting embossment spaced from their ends that serve as a stop to prevent over insertion of the splice clip 21 into the primary carriers 20.

The splice connector 21 may be made from electrical metallic tube (commonly referred to as "EMT") having an outside diameter and cross-sectional shape that is complementary to the inside diameter and cross-sectional shape of the primary carrier 20. The splice connector 21 has a slot 21*b* along its length to allow it to mate with a lock seam 20*a* in the tube carrier 20, thus preventing rotation of the splice clip 21 and maintaining the angular alignment of the splice clip relative to the primary carriers 20.

Figure 5:
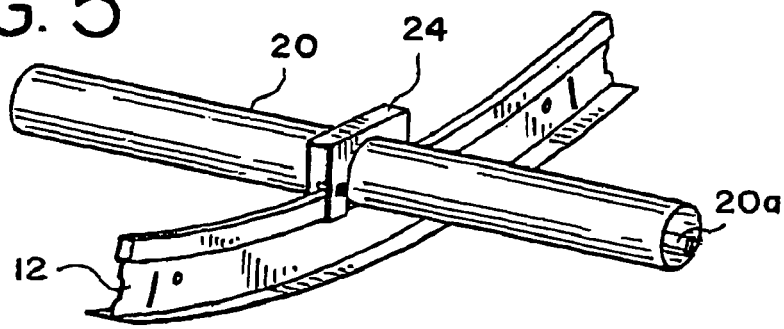
FIG. 5 is a perspective view of a portion of the grid system according to the present invention showing a clip for securing a primary carrier to a main runner.
Figure 6:
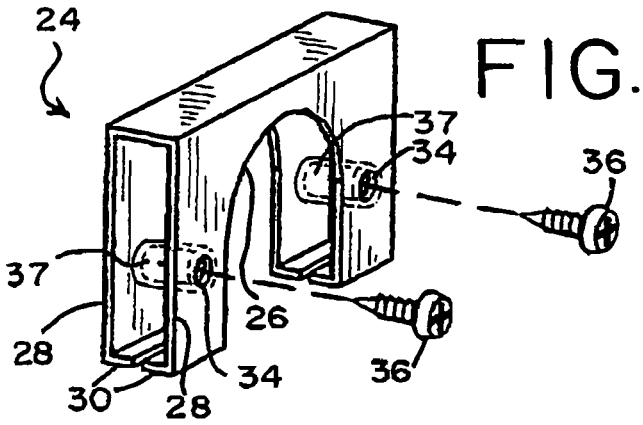
FIG. 6 is an enlarged perspective view of the clip for securing the primary carrier to the main runner.

With reference to FIGS. 5 and 6, clips 24 with cut-outs 26 are provided that fit over the top of the primary carrier 20 to secure the main runners 10 to the primary carrier 20. The cut-outs 26 are generally complementary in shape to the primary carrier and thus, in the illustrated embodiment, are generally an inverted U-shape. The clip 24 is provided with opposed faces 28, the bottom edges 30 of which terminate in inwardly-pointing lips that are adapted to support the bottom surface of the bulb of the main runner. Alternatively, the clip 24 may be formed with inwardly-pointing tabs (not shown) for the same purpose. The clip 24 has aligned holes 34 in its opposed faces 28 for receiving screws 36 that draw together the lips or tabs on the clips so that they securely support the bulb of the main runner 10. The clip 24 preferably includes stand offs 37 that are received on the shanks of the screws 36 and are sized in length to prevent over-tightening for the screws.

Figure 7:
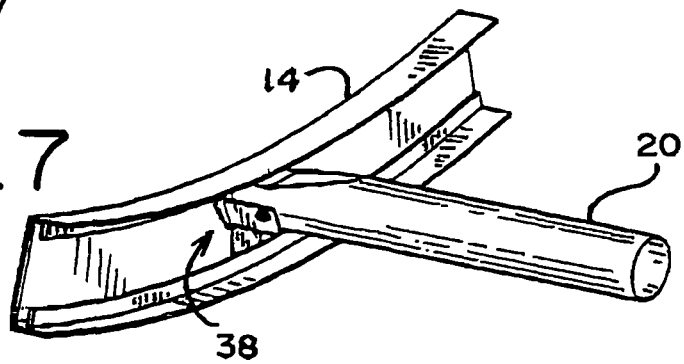
FIG. 7 is a perspective view of a portion of the grid assembly showing a connection of a primary carrier to a perimeter trim piece.
Figure 8:
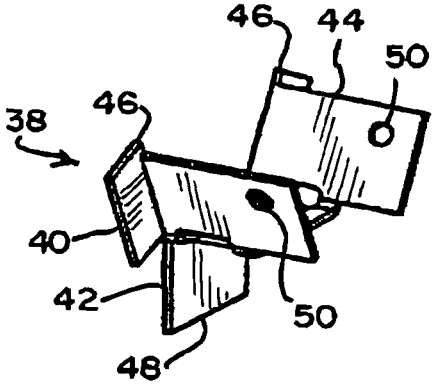
FIG. 8 is an enlarged perspective view of a clip for securing the primary carrier to the perimeter trim piece.

One advantage accruing to the present invention is that the primary carrier provides a cantilevered attachment point for the perimeter trim, allowing the hanger wire for suspending the grid to stand off from the end of the carrier tube, thus shielding the hanger wire from view. To this end, a perimeter clip 38 for securing the primary carrier 20 to a trim piece 14 is shown, best seen in FIGS. 7 and 8. The primary carrier perimeter clip 38 comprises three L-shaped segments 40, 42, 44, joined together on one leg of the L, that are bendable into a generally U-shaped member. When bent, the corner 46 of one leg of each of the outer L-shaped segments is partially received in the upper of two opposed slots on the trim pieces, while the edge 48 of the corresponding leg of the middle L-shaped segment is received in the lower of the two opposed slots. The other leg of each L-shaped segment extends generally perpendicularly from the trim piece 14 to support the primary carrier 20. Each of the two outer arms that support the primary carrier 20 includes an aperture 50 adapted to receive a screw or other fastener for positively securing the clip 38 to the primary carrier 20.

Figure 9:
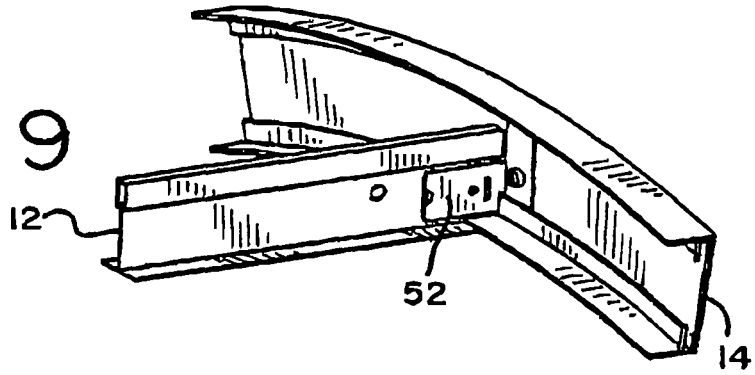
FIG. 9 is a perspective view of a portion of the grid system of the present invention showing the connection of a main runner to a trim piece.
Figure 10:
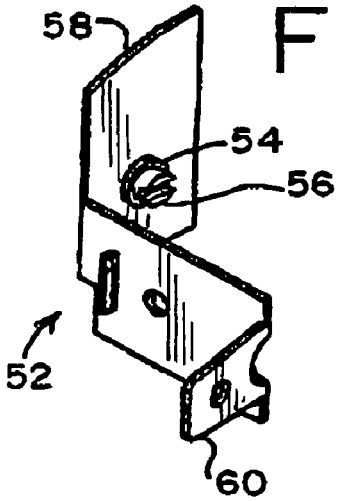
FIG. 10 is an enlarged perspective view of a clip for securing a main runner to a trim piece.

With reference to FIGS. 9 and 10, a second perimeter clip 52 is shown for securing the main runners 10 to a perimeter trim piece. (Such clips may also be used to secure cross tees, if used, to a perimeter trim piece.) The main runner perimeter clip 52 is also generally L-shaped, with one leg of the L having opposed edges that are received in the opposed slots of the straight trim piece 14. This leg preferably includes a tapped hole 54 for receiving a set screw 56 that may be tightened against the web of the trim piece 14 to lock the perimeter clip 52 thereto. Preferably, this leg has a curved edge 58 that permits the clip 52 to be positioned on the trim piece and then simply twisted to cause its edges to locate in the opposed slots in the trim piece. The other leg is adapted to lie along the web of the main runner 10, and includes an ear 60 which can be folded through a slot in the main runner 12 to lock the main runner thereto.

Figure 11:
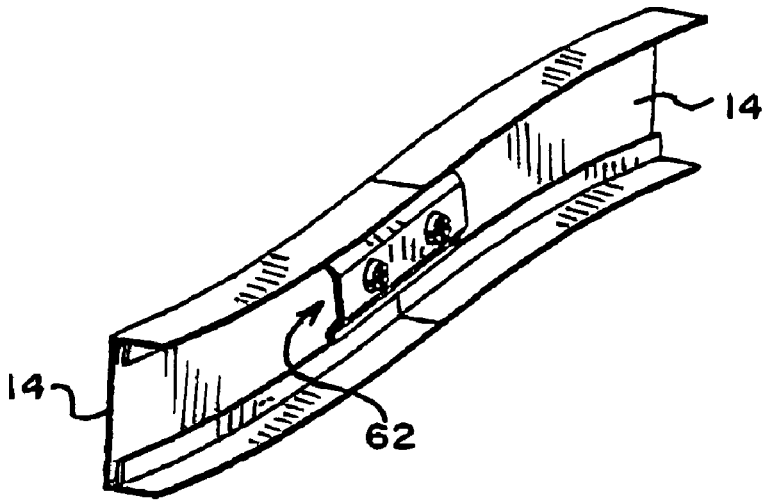
FIG. 11 is a perspective view of a portion of the grid system showing two pieces of trim connected to each other by means of a splice clip.
Figure 12:
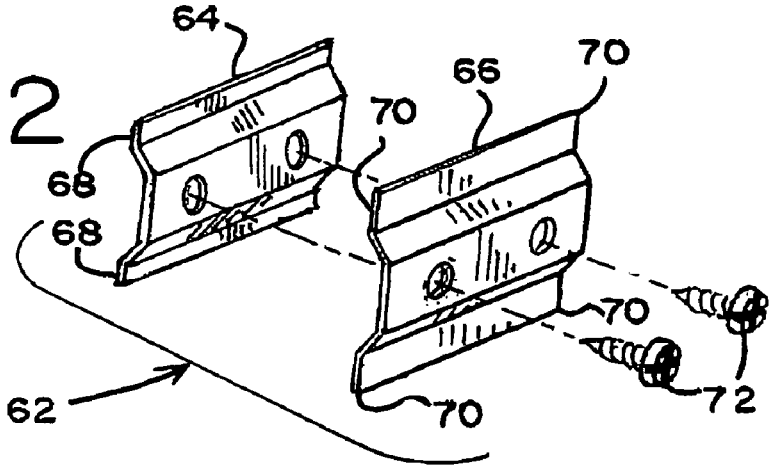
FIG. 12 is an enlarged exploded perspective view of the splice clip for connecting two trim pieces together.

Turning to FIGS. 11 and 12, a splice clip 62 is provided for joining lengths of perimeter trim 14 to each other. The splice clip 62 has two parts 64, 66. The first part 64 has opposed edges 68 which are received in the opposed slots on the trim piece. The second piece 66 overlies the first piece 64 to clamp the lips that define the slots in the trim piece between the two pieces of the splice clip 62. The second piece 66 has four corners 70 that are bent downwardly to engage the lips of the channels that receive the first piece 64. The two pieces 64, 66 of the splice clip 62 are attached together by a pair of screws 72.

Figure 13:
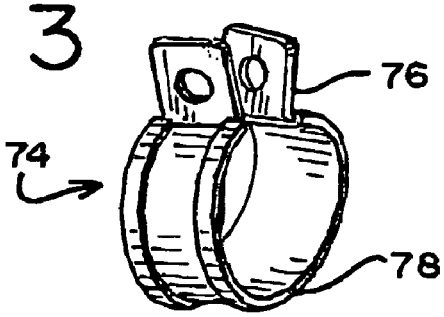
FIG. 13 is a perspective view of a hanger clip for securing the hanger wire to the primary carrier.

The grid system of the present invention is suspended by hanger wires secured to the primary carriers, rather than to the main runners. This minimizes the number of hanger wires required to support the system. For smaller-sized ceilings, the curved grid system as described can be easily and accurately assembled on the floor of the space in which it is to be installed, and then raised as a unit in order to secure the hanger wires to the tube carriers. Otherwise, the primary carriers 20 are first hung, and the remaining components of the grid system then secured thereto. With reference to FIGS. 1, 4 and 13, a plurality of hanger clips 74 is provided that secure the hanger wire to the primary carriers 20. The hanger clips 74 have a strap portion 76 that is partially covered with a resilient, rubber-like sleeve 78 that conforms to the shape of the surface of the tube carrier 20 contacted by it. The hanger clips 74 have a slightly oversized opening with respect to the diameter of the primary carrier in order to permit a minor amount of relative rotation between the hanger clip and the primary carrier. This ability to rotate with respect to each other allows a certain amount of "self centering" of the tube carrier with respect to the hanger wire, so that the hanger wire extends generally perpendicularly from the primary carrier. This subjects the hanger wire to less stress at the point at which it is secured to the hanger clip.

Thus, a suspended ceiling system particularly suited for a curved grid has been provided that facilitates accurate and quick assembly with enhanced structural rigidity. While the invention has been described in terms of a preferred embodiment, it is not intended to be limited to the same. Indeed, variations are contemplated that are within the ordinary skill in the art. For example, while the system has been described in connection with curved main runners, the primary carriers could also be used with a more conventional planar grid system. In addition, while cross tees are not required for structural reasons, they may still be utilized with the present invention for aesthetic reasons if, e.g., the lay-in panels have an edge reveal. Also, the primary carrier may have a cross-section other than generally circular without departing from the invention.

What is claimed:

1. A grid system having a width comprising:

a plurality of curved main runners in spaced parallel relationship, each having a strengthening bulb and being curved in a single plane;

one or more substantially linear elongated primary carriers, each primary carrier being substantially perpendicular to each main runner and spanning substantially the width of the grid system, each having a slot therein adapted to receive the strengthening bulb of each of the main runners and comprising at least two coaxial tube members secured to each other end-to-end by a splice tube, the splice tube having an outside diameter corresponding to the inside diameter of the tube members; and one or more first clips for securing each of the main runners to each primary carrier with the curves of the main runners being aligned.

2. The grid system of claim 1 further comprising a plurality of spaced primary carriers, the primary carriers having ends that overlap so that together the primary carriers span substantially the width of the grid system.

3. The grid system of claim 1 wherein the primary carrier comprises a carrier tube having a circular cross-section and the first clip has a central open portion with a shape complimentary to the cross-section of the tube.

4. The grid system of claim 1 wherein the tube members are formed with a lock seam and the splice tube includes a slot adapted to receive the lock seam.

5. The grid system of claim 1 wherein at least one of the tube members includes a stop to limit the extent of insertion of the splice tube into the tube member.

6. The grid system of claim 5 wherein the stop comprises an inwardly projecting embossment.

7. The grid system of claim 1 wherein the first clip is adapted to seat on the primary carrier and has opposed faces for capturing the bulb of the runner therebetween.

8. The grid system of claim 7 wherein the first clip includes at least one screw extending through the opposed faces for drawing the opposed faces toward one another for capturing the bulb of the main runner.

9. The grid system of claim 8 wherein the first clip includes a stand-off between the opposed faces to limit the degree to which the opposed faces can be drawn toward one another.

10. The grid system of claim 9 wherein the stand-off is a tubular member adapted to be received on the shaft of the screw.

11. The grid system of claim 1 further comprising at least one trim piece that defines an outer edge of the grid, the trim pieces having opposed slots, and a second clip comprising three L-shaped segments, each segment having a first leg to which the adjacent segments are secured to each other and adapted to support the primary carrier and a second leg extending generally perpendicular to the first leg, a portion of which is a adapted to be received in one of the opposed slots on the trim piece.

12. A grid system having a width comprising:

a plurality of curved main runners in spaced parallel relationship, each having a strengthening bulb and being curved in a single plane;

one or more substantially linear elongated primary carriers, each primary carrier being substantially perpendicular to each main runner and spanning substantially the width of the grid system, each having a slot therein adapted to receive the strengthening bulb of each of the main runners; and one or more first clips adapted to seat on the primary carrier and having opposed faces for capturing the bulb of the runner therebetween for securing of the main runners to each primary carrier with the curves of the main runners being aligned, each first clip having at least one screw extending through the opposed faces for drawing the opposed faces toward one another to capture the bulb of the main runner, each first clip including a stand-off between the opposed faces to limit the degree to which the opposed faces can be drawn toward one another.

* * * * *